US007104330B2

(12) United States Patent
Legras et al.

(10) Patent No.: US 7,104,330 B2
(45) Date of Patent: Sep. 12, 2006

(54) MARINE RISER TOWER

(75) Inventors: Jean-Luc Bernard Legras, Houston, TX (US); Grégoire François Christian De Roux, Paris (FR); Tegwen Bertrand Marie Miorcec De Kerdanet, Paris (FR)

(73) Assignee: Stolt Offshore S.A., (FR)

( * ) Notice: Subject to any disclaimer, the term of this patent is extended or adjusted under 35 U.S.C. 154(b) by 0 days.

(21) Appl. No.: 10/451,696

(22) PCT Filed: Jan. 8, 2002

(86) PCT No.: PCT/EP02/00511

§ 371 (c)(1),
(2), (4) Date: Nov. 17, 2003

(87) PCT Pub. No.: WO02/053869

PCT Pub. Date: Jul. 11, 2002

(65) Prior Publication Data

US 2004/0074648 A1 Apr. 22, 2004

(30) Foreign Application Priority Data

Jan. 8, 2001 (GB) ..... 0100413.4
Feb. 7, 2001 (GB) ..... 0103020.4
Oct. 16, 2001 (GB) ..... 0124801.2

(51) Int. Cl.
*E21B 29/12* (2006.01)

(52) U.S. Cl. ..... 166/367; 166/352; 405/224.4; 137/155

(58) Field of Classification Search ..... 166/356, 166/367, 368, 352; 137/236.1, 580, 155; 405/224.2, 224.4; 41/4, 5
See application file for complete search history.

(56) References Cited

U.S. PATENT DOCUMENTS 3,140,744 A 7/1964 Bailly ..... 166/61
3,517,110 A * 6/1970 Morgan ..... 174/47
3,526,086 A * 9/1970 Morgan ..... 138/111
3,677,302 A * 7/1972 Morgan ..... 138/106
4,332,509 A 6/1982 Reynard et al. ..... 405/168
4,401,164 A 8/1983 Baugh ..... 166/379
4,462,717 A * 7/1984 Falcimaigne ..... 405/224.3
4,941,773 A * 7/1990 Vergouw ..... 405/157
4,963,420 A 10/1990 Jarrin et al. ..... 428/36.9
5,085,275 A 2/1992 Gondouin ..... 166/303
5,330,294 A 7/1994 Guesnon ..... 405/224
5,813,106 A 9/1998 Haug et al. ..... 29/429
6,082,391 A 7/2000 Thiebaud et al. ..... 137/236

(Continued)

FOREIGN PATENT DOCUMENTS

DE 19727493 A1 1/1999

(Continued)

OTHER PUBLICATIONS

"Pipelines and Risers" by Bai, Elsevier Ocean Engineering book Series, vol. 3, 2001, pp. 451-453.

*Primary Examiner*—Thomas A Beach
(74) *Attorney, Agent, or Firm*—Sheridan Ross P.C.

(57) ABSTRACT

This invention relates to a marine riser tower (112, 114) for use in the production of hydrocarbons from offshore wells. The riser tower (112, 114) includes a plurality of fluid conduits, which may comprise production flow lines (P), gas-lift lines (G), water injection lines (W) and/or umbilicals (U). The conduits are supported in a single structure, and at least one of said conduits is provided with its own insulation within said structure.

7 Claims, 8 Drawing Sheets

U.S. PATENT DOCUMENTS

| | | | | |
|---|---|---|---|---|
| 6,102,077 | A * | 8/2000 | Legallais et al. | 138/115 |
| 6,146,052 | A * | 11/2000 | Jacobsen et al. | 405/169 |
| 6,364,022 | B1 * | 4/2002 | Kodaissi et al. | 166/367 |
| 6,764,365 | B1 * | 7/2004 | Quigley et al. | 441/133 |
| 6,772,840 | B1 * | 8/2004 | Headworth | 166/302 |

FOREIGN PATENT DOCUMENTS

| | | |
|---|---|---|
| EP | 0424225 A1 | 4/1991 |
| EP | 0467635 A2 | 1/1992 |
| GB | 1285530 | 8/1972 |
| GB | 2326166 | 12/1998 |
| GB | 2337542 | 11/1999 |
| GB | 2346188 | 8/2000 |
| GB | 2351301 | 12/2000 |
| WO | WO 92/19903 | 11/1992 |
| WO | WO 99/57413 | 11/1999 |
| WO | WO 00/40886 | 7/2000 |
| WO | WO 01/14687 | 3/2001 |
| WO | WO 02/12776 | 2/2002 |

* cited by examiner

MARINE RISER TOWER

The present invention relates to a marine riser tower, of the type used in the transport of hydrocarbon fluids (gas and/or oil) from offshore wells. The riser tower typically includes a number of conduits for the transport of fluids and different conduits within the riser tower are used to carry the hot production fluids and the injection fluids which are usually colder.

The tower may form part of a so-called hybrid riser, having an upper and/or lower portions ("jumpers") made of flexible conduit U.S. Pat. No. 6,082,391 proposes a particular Hybrid Riser Tower consisting of an empty central core, supporting a bundle of riser pipes, some used for oil production some used for water and gas injection. This type of tower has been developed and deployed for example in the Girassol field off Angola. Insulating material in the form of syntactic foam blocks surrounds the core and the pipes and separates the hot and cold fluid conduits. Further background is to be published in a paper *Hybrid Riser Tower: from Functional Specification to Cost per Unit Length* by J-F Saint-Marcoux and M Rochereau, DOT XIII Rio de Janeiro, 18 Oct. 2001.

The foam fabrication and transportation process is such that the foam comes in elements or blocks which are assembled together in the production at a yard. The fit of the elements in the tower is such that there will be gaps resulting from fabrication and assembly tolerances. A readably flowable fluid, such as seawater, takes the place of air in these gaps and a natural convection cycle develops. Natural convection under the form of thermosiphons can result in very high thermal losses.

When a riser tower houses both hot flowlines and cold water injection lines, cold seawater surrounds the water injection lines up to the top of the tower. Upon shutdown this cold water naturally descends to be replaced by warmer seawater surrounding the flowlines. This colder fluid accumulates around the conduits such as the production line at the bottom of the tower, and accelerates the heat transfer from the production fluid in the conduit. This makes it difficult to meet the cooldown time criteria of the riser, locally.

Measures such as gaskets may be provided to break up this convection but have only limited success, and add to the expense of the construction.

GB-A-2346188 (2H) presents an alternative to the hybrid riser tower bundle, in in particular a "concentric offset riser". The riser in this case includes a single production flowline located within an outer pipe. Other lines such as gas lift chemical injection, test, or hydraulic control lines are located in the annulus between the core and outer pipe. The main flow path of the system is provided by the central pipe, and the annular space may be filled with water or thermal insulation material. Water injection lines, which are generally equal in diameter to the flowline, are not accommodated and presumably require their own riser structure.

EP-A-0467635 discloses a thermal insulting material for use in pipeline bundles an pipeline riser caissons. The material is a gel-based material that may be used to fill the space between the lines in the riser.

The aim of the present invention is to provide a riser tower having a reliable thermal efficiency and/or greater thermal efficiency for a given overall cost. Particular embodiments of the invention aim in particular to eliminate heat transfer by convection within and around the tower, to achieve very low heat transfer. Particular embodiments of the invention aim for example to achieve heat transfer rates of less than 1 $W/m^2K$.

The invention in a first aspect provides a riser tower wherein a plurality of rigid fluid conduits including at least one production flowline are supported in a single structure, at least one of said conduits being provided with its own insulation within the structure.

In particular embodiments, insulated lines are used for of production flowlines and preferably also for gas lift lines. Insulation may be provided also for injection lines, depending on actual temperature operating conditions.

A particular application of the present invention is in Hybrid Riser Towers, for example of free-standing type, where flexible lines are connected to the riser at top and/or bottom.

The insulation may serve instead of or in addition to buoyant material surrounding the riser as a whole.

The insulation may take the form of a coating applied to the conduit, a dual-wall (pipe-in-pipe) structure or a combination of both.

The riser tower may include a tubular Postural core. One or more of the conduits (such as production and/or gas lift lines) may be located inside the core, to isolate it further from the environment and the water lines. This feature is the subject of a co-pending application.

These and ether advantageous features are defined in the appended claims.

BRIEF DESCRIPTION OF THE DRAWINGS

Embodiments of the invention will now be described, by way of example only, by reference to the accompanying drawings, in which.

DETAILED DESCRIPTION OF THE EMBODIMENTS

Figure 1:
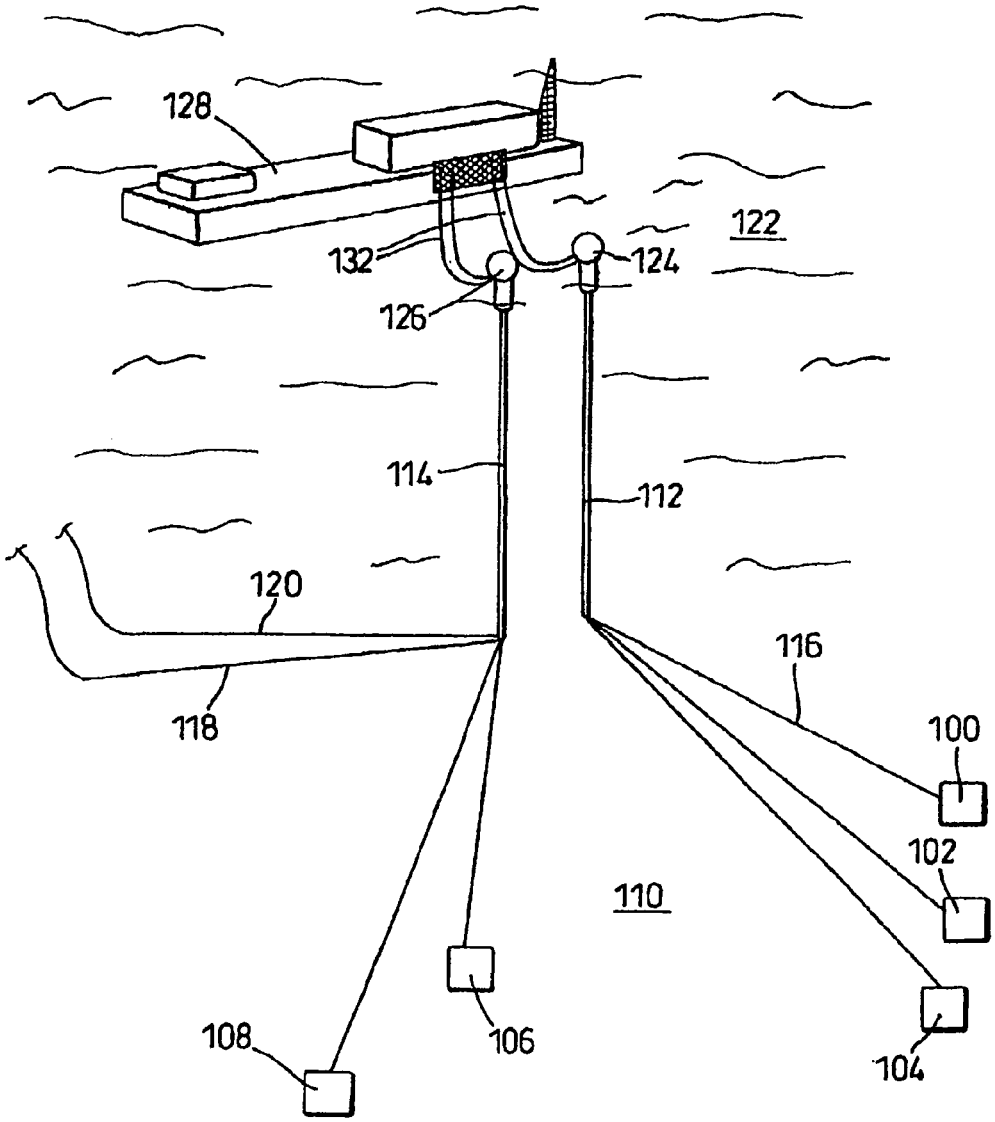
FIG. 1 illustrates schematically a deepwater installation including a floating production and storage vessel and rigid pipeline riser bundles in a deepwater oil field.

Referring to FIG. 1, the person skilled in the art will recognise a cut-away view of a seabed installation comprising a number of well heads, manifolds and other pipeline equipment 100 to 108. These are located in an oil field on the seabed 110.

Vertical riser towers constructed according to the present invention are provided at 112 and 114, for conveying production fluids to the surface, and for conveying lifting gas, injection water and treatment chemicals such as methanol from the surface to the seabed. The foot of each riser, 112, 114, is connected to a number of well heads/injection sites 100 to 108 by horizontal pipelines 116 etc.

Further pipelines 118, 120 may link to other well sites at a remote part of the seabed. At the sea surface 122, the top of each riser tower is supported by a buoy 124, 126. These towers are prefabricated at shore facilities, towed to their operating location and then installed to the seabed with anchors at the bottom and buoyancy at the top.

A floating production and storage vessel (FPSO) 128 is moored by means not shown, or otherwise held in place at the surface. FPSO 128 provides production facilities, storage and accommodation for the wells 100 to 108. FPSO 128 is connected to the risers by flexible flow lines 132 etc., for the transfer of fluids between the FPSO and the seabed, via risers 112 and 114.

As mentioned above, individual pipelines may be required not only for hydrocarbons produced from the seabed wells, but also for various auxiliary fluids, which assist in the production and/or maintenance of the seabed installation. For the sake of convenience, a number of pipelines carrying either the same or a number of different types of fluid are grouped in "bundles", and the risers 112, and 114 in this embodiment comprise bundles of conduits for production fluids, lifting gas, injection water, and treatment chemicals, methanol.

As is well known, efficient thermal insulation is required around the horizontal and vertical flowlines, to prevent the hot production fluids overly cooling, thickening and even solidifying before they are recovered to the surface.

Figure 2:
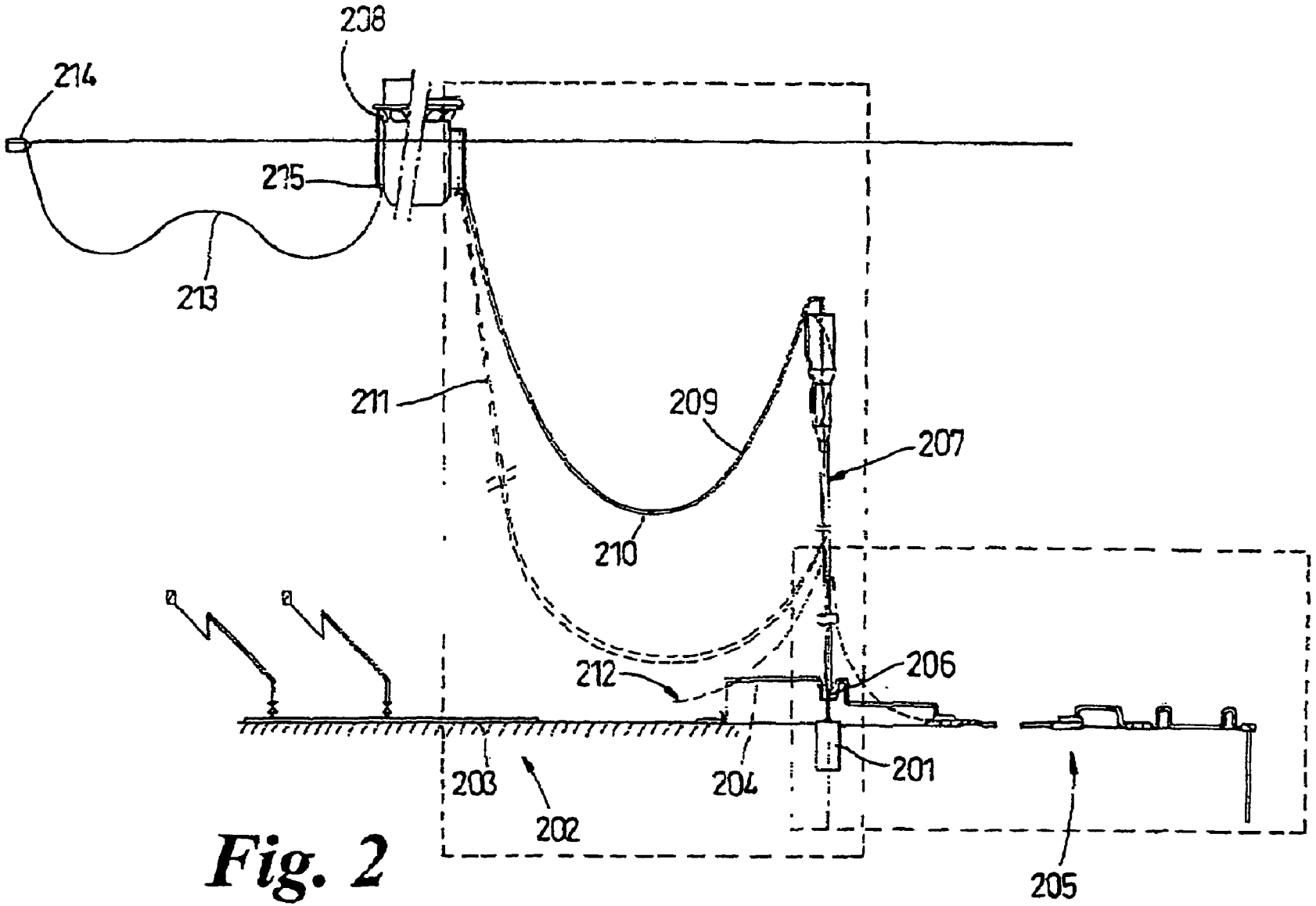
FIG. 2 is a more detailed side elevation of an installation of the type shown in FIG. 1 including a riser tower according to a first embodiment of the present invention.

Now referring to FIG. 2 of the drawings, there is shown in more detail a specific example of a hybrid riser tower installation as broadly illustrated in FIG. 1.

The seabed installation includes a well head 201, a production system 205 and an injection system 202. The injection system includes an injection line 203, and a riser injection spool 204. The well head 201 includes riser connection means 206 with a riser tower 207, connected thereto. The riser tower may extend for example 1200 m from the seabed almost to the sea surface. An FPSO 208 located at the surfaces connected via a flexible jumper 209 and a dynamic jumper bundle 210 to the riser tower 207, at or near the end of the riser tower remote from the seabed. In addition the FPSO 208 is connected via a dynamic (production and injection) umbilical 211 to the riser tower 207 at a point towards the mid-height of the tower. Static injection and production umbilicals 212 connects the riser tower 207 to the injection system 202 and production system 205 at the seabed.

The FPSO 208 is connected by a buoyancy aided export line 213 to a dynamic buoy 214. The export line 213 being connected to the FPSO by a flex joint 215.

Figure 3:
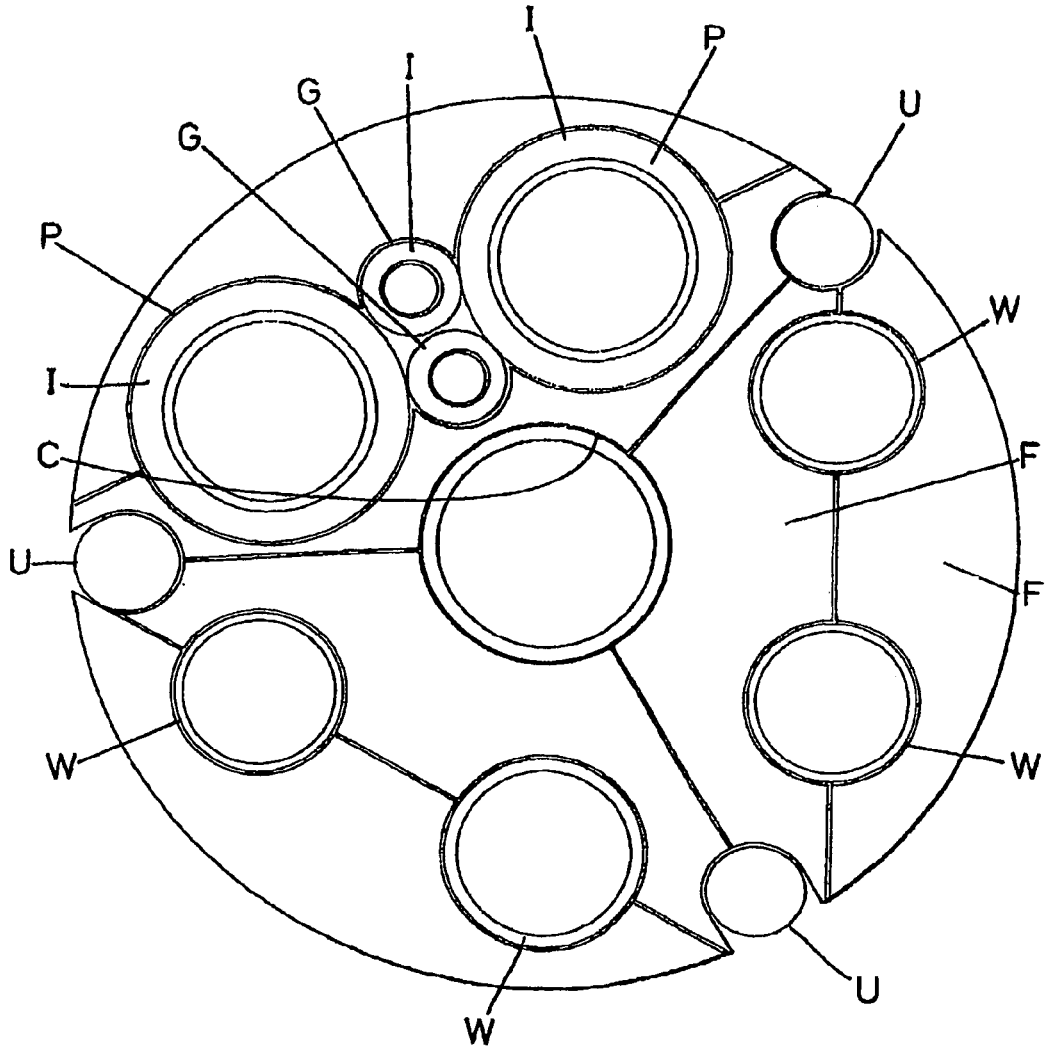
FIG. 3 is a cross-sectional view of a riser bundle suitable for use in the installation of FIGS. 1 and 2.

FIG. 3 shows in cross-section one of the riser towers 112 or 114. The central metallic core pipe is designated C, and is empty, being provided for structral purposes only. If sealed and filled with air, it also provides buoyancy. Arrayed around the core are production flowlines P, gas lift lines G, water injection lines W and umbilicals U.

Flowlines P and gas lift lines G in this example are coated directly with an additional insulation material I. This may be a solid coating of polypropylene (PP) or the like, or it may be a more highly insulating material, such as PUR foam or microporous material. PP coating stations are commonplace, and coatings as tick as 50–120 mm will provide substantial insulation. The designations C, P, W, G, F, U and I are used throughout the description and drawings with the same meaning.

The various lines P, G, W, and U are held in a fixed arrangement about the core. In the illustrated example, the lines are spaced and insulated from one another by shaped blocks F of syntactic foam or the like, which also provides buoyancy to the structure.

In general, two cases can be considered:

Either the insulation requirements (both steady state and cool down) can be satisfied with the insulation coati, in which case there is virtually no chance of natural convection developing to the outside of the line. Expensive gaskets and filler material are then eliminated Or the insulation must be complemented by another insulating material such as syntactic foam blocks F.

In the latter case:

During steady state, the heat transfer loss by natural convection is nevertheless reduced by the insulation on the pipes because:

The temperature difference is reduced,

The effect of heat losses at the junction of two foam blocks is reduced;

At shutdown the thermal inertia of the line, increased by the thermal inertia of the foam, reduces the heat transfer making it easier to meet the cooldown time.

In either case, monitoring of the central temperature and pressure can be easily provided by embedding a Bragg effect optic fibre.

Of course the specific combinations and types of conduit are presented by way of example only, and the actual provisions will be determined by the operational requirements of each installation. The skilled leader will readily appreciate how the design of the installation at top and bottom of the riser tower can be adapted from the prior art, including U.S. Pat. No. 6,082,391, mentioned above, and these are not discussed in further detail herein.

In an alternative embodiment, the core may accommodate some of the lines, and in particular the hot, production flow lines P and/or lift lines G. This is subject of our copending applications GB 0100414.2 and GB 0124802.0 (63753 GB and 63753 GB2). In cases where water convection in the gaps between the foam blocks F leads to significant heat flow, these gaps can be packed with material such as grease, to prevent convection. This technique is subject of our co-pending application number PCT/EP01/09575 which claims priority from GB0018999.3 and GB 0116307.0, not published at the priority date of the present application.

Figure 4:
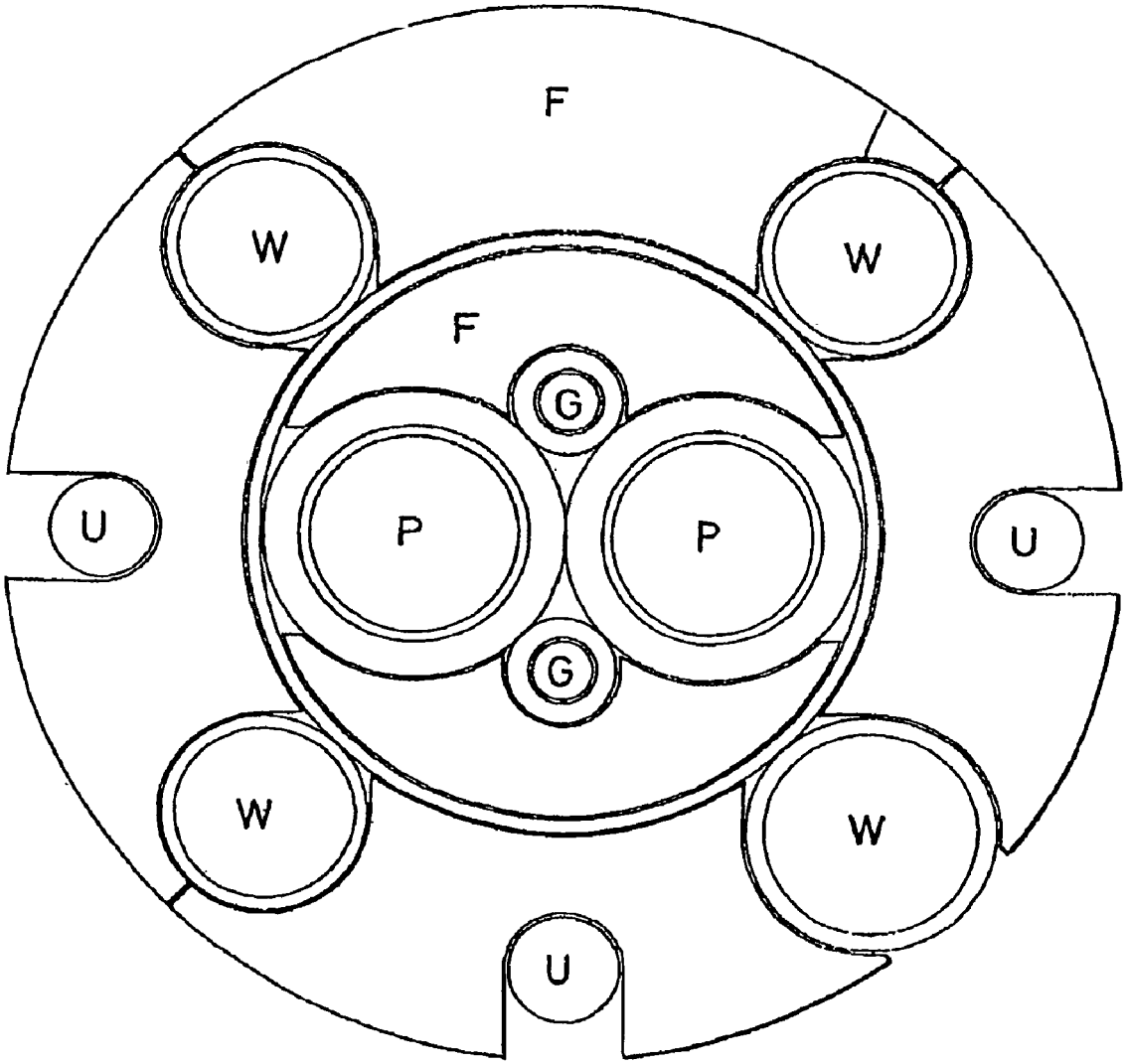
FIG. 4, 5 and 6 are cross-sectional views of alternative riser bundle arrangements to that shown in FIG. 3.
Figure 5:
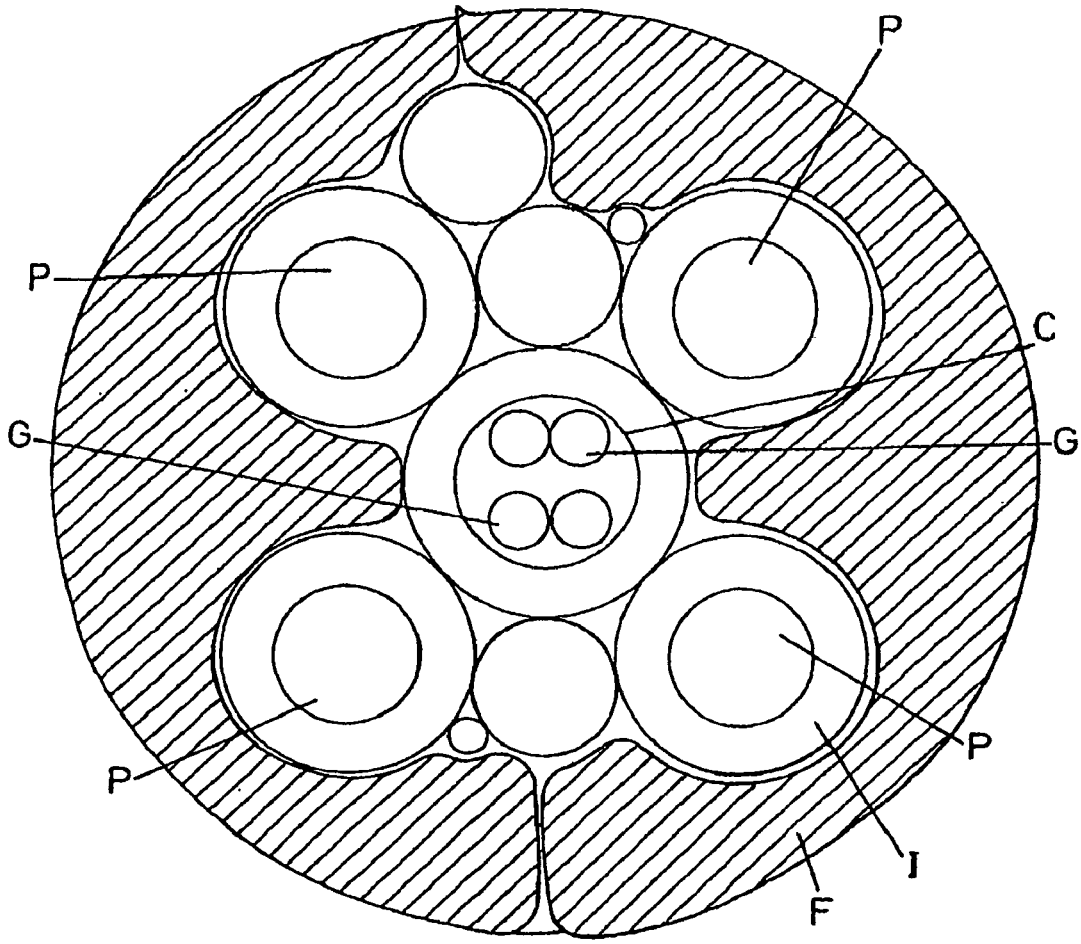

FIGS. 4 and 5 illustrate two alternative cross-sections where the space inside the core is used to accommodate some of the conduits.

In FIG. 4 there is shown a construction of riser having a hollow core pipe C. Located within the core pipe are two production lines P and two gas lift lines G and located outside the core pipe are four water injection lines W and three umbilicals U. The spaces between the line both internally and externally of the core pipe P are also filled with blocks F of syntactic foam that are shaped to meet the specific design requirements for the system. It should be noted that in this example the foam blocks externally located about the core pipe C have been split diametrically to fit around the core between the water injection lines, which do not themselves require substantial insulation from the environment. There are no insulated lines within the foam outside the core, and no circumferential gaps between the foam blocks, such as would be required to insulate production and gas lift lines located outside the core.

Production flowlines P in this example also carry their own insulation I, being coated with a polypropylene layer, of a type known per se, which also adds to their insulation properties. Relatively thick PP layers can be formed, for example of 50–120 mm thickness. Higher-insulated foam and other coatings can be used, as explained below.

FIG. 5 of the drawings shows a third example in which only the gas lift lines G are located in the core pipe C, and the production lines P are located externally of the core pipe C with the water injection lines W and umbilicals U. The figure shows the use of foam insulation F internally of the core pipe C but it will be appreciated that the use of grease or wax like material insulation is another options. In this example, since the production lines P are closer to the environment and to the water lines, they are provided with enhanced insulation I such as PUR or other foam. Pipe-in-pipe insulation (essentially a double-walled construction) is also possible here.

As will be appreciated by those skilled in the art the functional specification of the tower will generally require one or two sets of lines, and may typically include within each set of lines twin production flowlines to allow pigging and an injection line. A single water injection line may be sufficient, or more than one may be provide.

Figure 6:
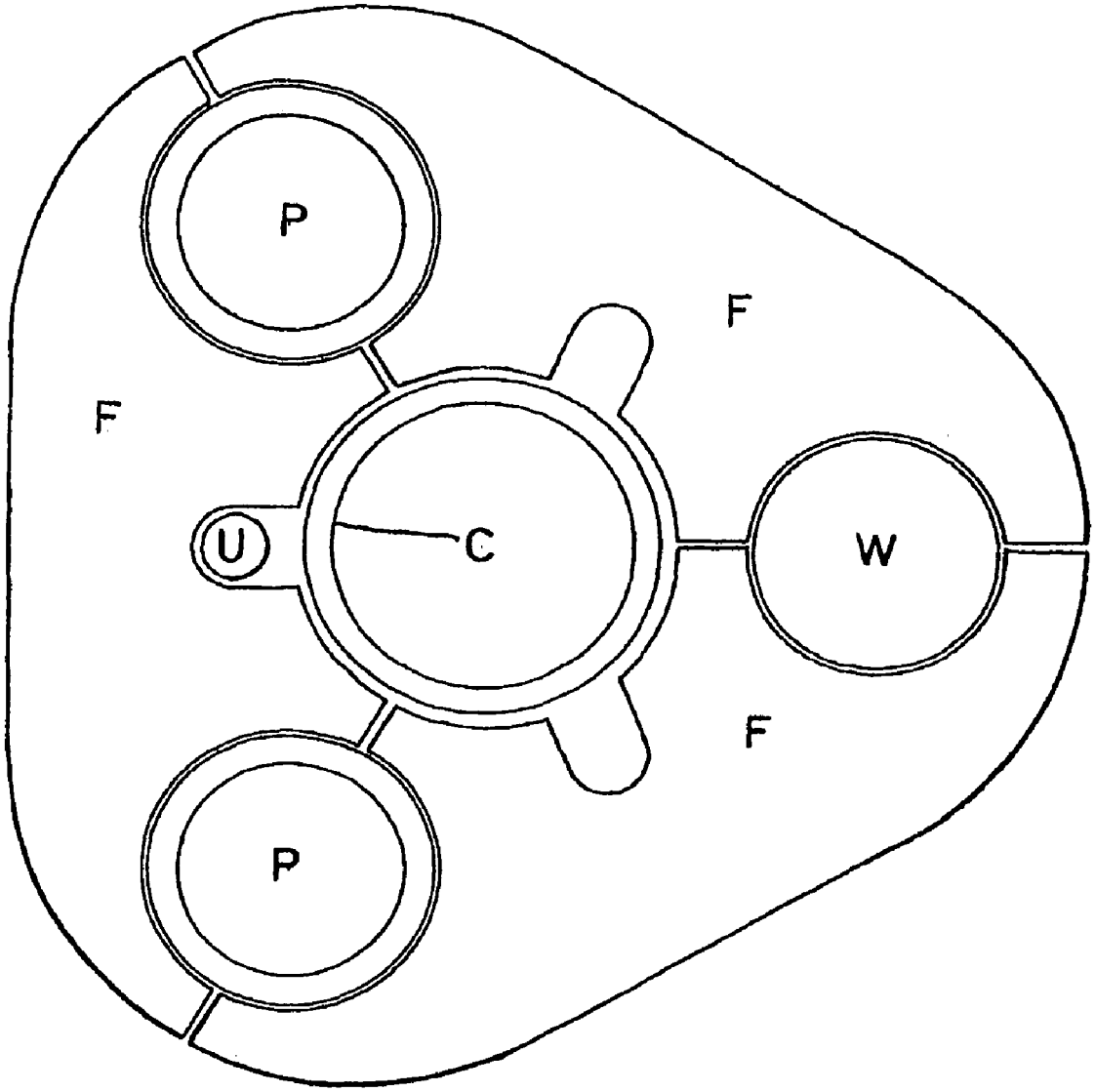

FIG. 6 of the drawings shows in cross-section a simple three-line bundle. In this arrangement the core pipe C supports just two production lines P and an injection line W which are evenly distributed thereabouts in a triangular configuration. The lines P. W are surrounded by insulation blocks F. The need for blocks F to provide insulation is reduced by the coating on the production lines P, reducing the amount of foam material required for insulation purposes. The amount of foam is thereby reduced to what is required for buoyancy and mechanical support.

Figure 7:
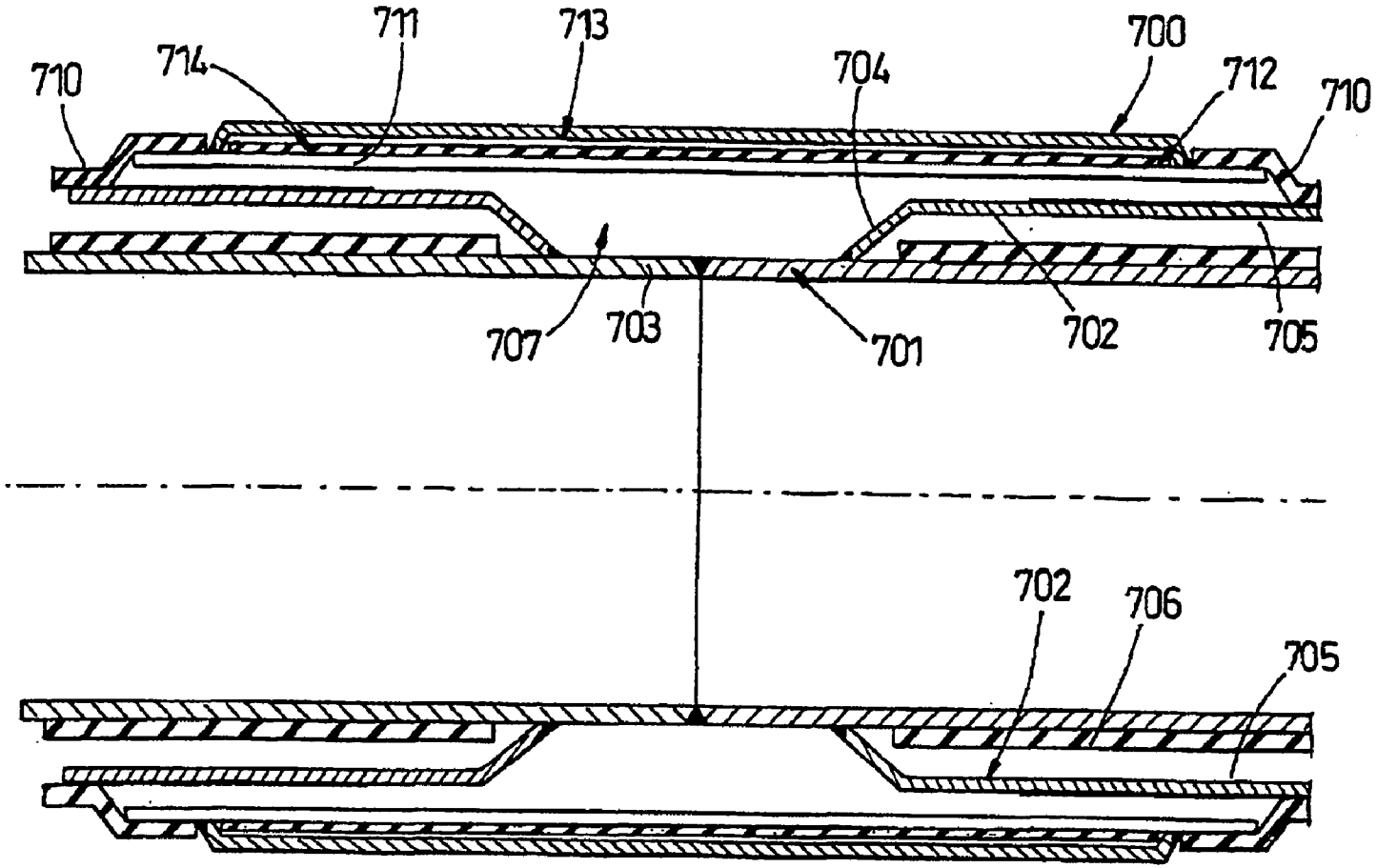
FIG. 7 is a partial longitudinal cross-section of an insulated flowline for use in the riser bundle of FIG. 3 or 4, in which the insulation includes a pipe-in-pipe structure

FIG. 7 of the drawings shows an alternative construction of an insulated flowline suitable for use with the riser described above as well as in other similar types of applications, this construction for the flowline can be described as a "pipe in pipe" arrangement, known per se in the art. This arrangement is generally provided in pre-fabricated sections 700 for fitting, for example welding, together and FIG. 7 shows in longitudinal cross-section the joint between two such sections, which naturally extend to left and right of the picture.

Each section comprises a central pipe 701 for the transport of fluids such as production fluids and a second pipe 702 in which the pipe 701 is housed for the major part of its length. Ends 703 of the pipe 701 extend beyond the second pipe 702 and enable the sections 700 of the pipe 701 to be secured together in end to end relationship so as to form a pipeline. The second pipe 702 is bent down at its ends 704 to be welded to the outside of the pipe 701 near to the ends 703 and so defines a space 705 between the two pipes. This space 705 provides and or houses the insulation for the pipeline.

In one embodiment a layer 706 of an insulating material, may be provided over the outer surface of the pipe 701 within the space 705. The insulating material may be a microporous material; for example ISOFLEX (a Trade Mark of Microtherm) which is a ceramic like material. With this type of arrangement a gap will still be present between the layer 706 and the inner surface of the pipe 702. This space 705 may be a simple space filled with air or other gas. The pressure in this space 705 may be normal atmospheric, or a partial vacuum may be created so as to reduce convective heat losses.

In an alternative arrangement the space 705 may be filled with a foam material such as a polyurethane foam so as to provide the insulation.

In order to protect and insulate the area around the join in the flowline, it is encased and fixed within a joint 700. The joint 700 comprises a sleeve 711 having an outer surrounding sleeve 712 which as with the section defines a space 714 in which insulating material is located, for example a layer 714 of ISOFLEX as shown in FIG. 7, or polyurethane foam, and two heat shrink end collars 710. The sleeve arrangement 711, 712 and the heat shrink collars 710 are located about one of the sections prior to welding of two sections. When welding is complete the component are slid into place about the join in the pipe. An epoxy resin material is injected into the space 707 defined between the sleeve arrangement and the flowline to fill that space. The heat shrink collars 710 are then heated so that they shrink and seal the sleeve arrangement to the flowline.

Any of the insulated flowlines in the embodiments described could be of pipe-in-pipe construction as just described with reference to FIG. 7 of the drawings.

Figure 8:
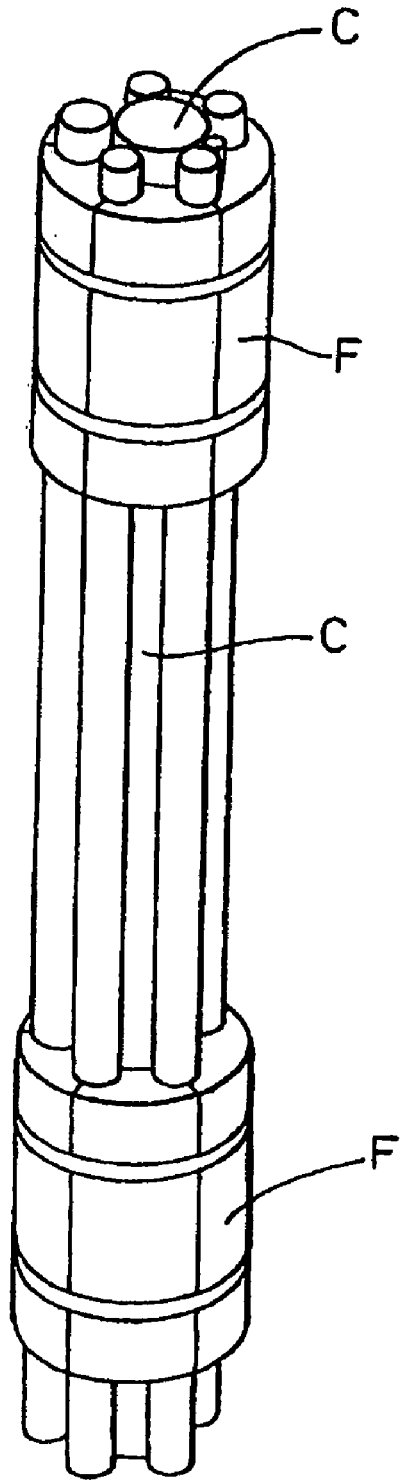
FIG. 8 illustrates a modification of the tower of any of the above examples, in which the foam blocks extend only over parts of the tower's length.

FIG. 8 illustrates a stepped tower construction, compatible with any of the examples of FIG. 2, 3 and 4, showing that the foam blocks F need not extend the full length of the tower. In this example the foam insulating material is provided in discrete sections spaced apart along the length of the riser tower. Advantages of the stepped tower include reduced cost, and controllable buoyancy. Another advantage of varying the cross-section along the length of the tower is a reduced tendency to vortex-induced vibration, under the influence of water currents. In embodiments where some of the warmer lines are outside the core, individual or group insulation of the lines is of course necessary, at least in the sections between the foam blocks, as in the co-pending application mentioned above.

The invention claimed is:

1. A marine riser tower for use in the production of hydrocarbons from offshore wells, wherein a plurality of fluid conduits including at least one production flow line are supported in a single supporting structure, and at least one of said conduits is provided with its own insulation independent of said supporting structure; and wherein the insulated conduit is gas lift line.

2. A marine riser tower for use in the production of hydrocarbons from offshore wells, wherein a plurality of fluid conduits including at least one production flow line are supported in a single supporting structure, and at least one of said conduits is provided with its own insulation independent of said supporting structure; and wherein the fluid conduits include at least one water injection line.

3. A marine riser tower for use in the production of hydrocarbons from offshore wells, wherein a plurality of fluid conduits including at least one production flow line are supported in a single supporting structure, and at least one of said conduits is provided with its own insulation independent of said supporting structure;

wherein the riser tower has a tubular core, and said core accommodates some of the conduits and not others; and wherein the core accommodates a plurality of gas lift lines, while associated production lines are individually insulated and located outside the core.

4. A marine riser tower for use in the production of hydrocarbons from offshore wells, wherein a plurality of fluid conduits including at least one production flow line are supported in a single supporting structure, and at least one of said conduits is provided with its own insulation independent of said supporting structure; and wherein said insulation includes a coating applied to the at least one conduit.

5. A marine riser tower for use in the production of hydrocarbons from offshore wells, wherein a plurality of fluid conduits including at least one production flow line are supported in a single supporting structure, and at least one of said conduits is provided with its own insulation independent of said supporting structure;

buoyant material surrounding the riser as a whole at least at some points along its length; and wherein said buoyant material is provided as foam blocks spaced along the length of the riser.

6. A marine riser tower for use in the production of hydrocarbons from offshore wells, wherein a plurality of fluid conduits including at least one production flow line are supported in a single supporting structure, and at least one of said conduits is provided with its own insulation independent of said supporting structure; buoyant material surrounding the riser as a whole at least at some points along its length; and wherein foam material is provided in discrete sections spaced apart along the length of the riser.

7. A marine riser tower for use in the production of hydrocarbons from offshore wells, wherein a plurality of fluid conduits including at least one production flow line are supported in a single supporting structure, and at least one of said conduits is provided with its own insulation independent of said supporting structure; and wherein flexible lines are connected to the riser at top and/or bottom.

* * * * *